United States Patent [19]

Fuller

[11] 4,405,000

[45] Sep. 20, 1983

[54] AUTOMATIC SHUTOFF VALVE

[75] Inventor: William J. Fuller, Fullerton, Calif.

[73] Assignee: Auto Stop Corporation, Lynwood, Calif.

[21] Appl. No.: 295,767

[22] Filed: Aug. 24, 1981

[51] Int. Cl.[3] ..... B65B 3/04

[52] U.S. Cl. ..... 141/198; 137/109; 137/393; 251/63; 251/320

[58] Field of Search ..... 251/63, 62, 62.5, 320; 141/192–198; 137/625.64, 109, 393

[56] References Cited

U.S. PATENT DOCUMENTS

| | | | |
|---|---|---|---|
| 3,363,641 | 1/1968 | Mylander | 141/192 |
| 3,502,109 | 3/1970 | Straight | 137/625.64 |
| 4,239,058 | 12/1980 | Peters | 251/63 |

OTHER PUBLICATIONS

Continental $NH_3$ Products Co., Inc., Operation and Service Instructions for SAFE-T-FILL A-3000 Valve.

*Primary Examiner*—Houston S. Bell, Jr.
*Attorney, Agent, or Firm*—Christie, Parker & Hale

[57] ABSTRACT

An automatic shutoff valve has a main inlet, a main outlet, and a main passage from the main inlet to the main outlet formed in a valve body. A piston chamber formed in the valve body has a valve seat in the main passage. A piston is movable back and forth through the piston chamber between a first position in engagement with the valve seat to close the main passage and a second position out of engagement with the valve seat to open the main passage. A first seal lies between the piston and the piston chamber to create on the piston a first area against which fluid pressure in the main passage acts to urge the piston toward its second position. An actuator is movable through a control chamber in fluid communication with one end of the piston chamber. The actuator moves between a first position and a second position to drive the piston toward its first position when the actuator moves toward its first position and to be driven by the piston toward its second position when the piston moves toward its second position. Preferably, but not necessarily, the actuator is integral with the piston. A second seal lies between the actuator and the control chamber to create on the actuator a second area larger than the first area against which fluid pressure in the control chamber acts to urge the actuator toward its first position. An inlet to, and an outlet from, the control chamber are in fluid communication with the second area of the actuator to permit the pressure of gas and liquid from the tank to act upon the second area when fed to the control chamber by a dip tube. A vent hole is provided in the control chamber to vent the space between the first and second seals to the atmosphere. The main inlet and the main outlet are arranged on parallel, laterally offset axes to facilitate formation of the part of the main passage leading from the piston chamber to the main outlet.

17 Claims, 8 Drawing Figures

AUTOMATIC SHUTOFF VALVE

BACKGROUND OF THE INVENTION

This invention relates to fluid control and, more particularly, to a tank filler valve that automatically shuts off when the tank is filled with a volatile liquid to a specified level.

It is dangerous to overfill a tank with highly volatile liquid, such as liquid petroleum gas (LPG), because of the possibility that the tank will rupture due to liquid expansion in the tank with rising temperature. For example, a tank should not be filled with propane to a level higher than 80% of its capacity. As a safety measure, tanks are currently provided with a dip tube that leads from a point at the maximum fill level within the tank to a point external to the tank. When the tank is filled to the maximum level, liquid is drawn through the tube and gives a visual signal outside the tank to the operator who is filling the tank. However, if the operator doesn't open the dip tube valve before filling the tank or inadvertently or intentionally continues to fill the tank after the visual signal is given, a dangerous overfilled condition will occur.

Mylander U.S. Pat. No. 3,363,641 discloses a flow control valve that automatically shuts off when a tank has been filled with a volatile liquid to a predetermined maximum level. The valve has a main inlet, a main outlet, and a main passage from the main inlet to the main outlet formed in a valve body. A piston chamber formed in the valve body has a valve seat in the main passage. A piston is movable back and forth through the piston chamber between a position in engagement with the valve seat to close the main passage, thereby shutting off the valve, and a position out of engagement with the valve seat to open the main passage. An O-ring seal between the piston and the piston chamber creates on the piston a first area against which fluid pressure in the main passage acts to urge the piston toward its open position. A control chamber lies in fluid communication with one end of the piston chamber. A dip tube having a small orifice leads from a point at the maximum fill level in the tank to the control chamber. The control chamber is vented to the atmosphere through another orifice substantially similar to the orifice in the dip tube. Within the control chamber the piston has a second area against which fluid from the dip tube acts to urge the piston toward its closed position. By virtue of the pair of orifices a substantially larger pressure is generated in the control chamber when liquid is fed thereto through the dip tube than when gas is. Before the tank is filled to its maximum level, the pressure of the gas fed to the control chamber by the dip tube is insufficient to overcome the force exerted on the first area of the piston due to the fluid pressure in the main passage. When the tank is filled to the maximum level, however, liquid is fed to the control chamber through the dip tube. The resulting larger pressure exerts a force on the second area of the piston larger than the force exerted on the first area thereof, and the piston moves to its closed position. The first and second areas of the piston are almost the same, so that a large increase in pressure must be developed when liquid is fed to the control chamber in order to shut off the valve.

In a commmercial version of the Mylander valve, an actuator plate, having a larger area than the first and second areas of the piston, loosely fits in the control chamber so that the pressure of the liquid from the dip tube drives the actuator plate against the second area of the piston, thereby shutting off the valve. Because of the loose fit of the actuator plate, there may be a delay of as long as eight to ten seconds from the time the liquid in the tube reaches its maximum level to the time the valve shuts off. Such delay may result in an appreciable overfilling of the tank.

SUMMARY OF THE INVENTION

According to the invention, a seal is introduced between the actuator and the control chamber in an automatic shutoff valve of the described type. This makes the actuator respond more quickly to the liquid pressure in the control chamber, and thereby reduces the delay between the time the fluid in the tank reaches its maximum level and the time the valve shuts off. Specifically, an automatic shutoff valve has a main inlet, a main outlet, and a main passage from the main inlet to the main outlet formed in a valve body. A piston chamber formed in the valve body has a valve seat in the main passage. A piston is movable back and forth through the piston chamber between a first position in engagement with the valve seat to close the main passage and a second position out of engagement with the valve seat to open the main passage. A first seal lies between the piston and the piston chamber to create on the piston a first area against which fluid pressure in the main passage acts to urge the piston toward its second position. An actuator is movable through a control chamber in fluid communication with one end of the piston chamber. The actuator moves between a first position and a second position to drive the piston toward its first position when the actuator moves toward its first position and to be driven by the piston toward its second position when the piston moves towards its second position. Preferably, but not necessarily, the actuator is integral with the piston. A second seal lies between the actuator and the control chamber to create on the actuator a second area substantially larger than the first area against which fluid pressure in the control chamber acts to urge the actuator toward its first position. An inlet to, and an outlet from, the control chamber are in fluid communication with the second area of the actuator to permit the pressure of gas and liquid from the tank to act upon the second area when fed to the control chamber by a dip tube.

According to a feature of the invention, a vent hole is provided in the control chamber to vent the space between the first and second seals to the atmosphere.

According to another feature of the invention, the main inlet and the main outlet are arranged on parallel, laterally offset axes to facilitate formation of the part of the main passage leading from the piston chamber to the main outlet.

BRIEF DESCRIPTION OF THE DRAWINGS

The features of a specific embodiment of the best mode contemplated of carrying out the invention are illustrated in the drawings, in which.

DETAILED DESCRIPTION OF THE SPECIFIC EMBODIMENT

Figure 1:
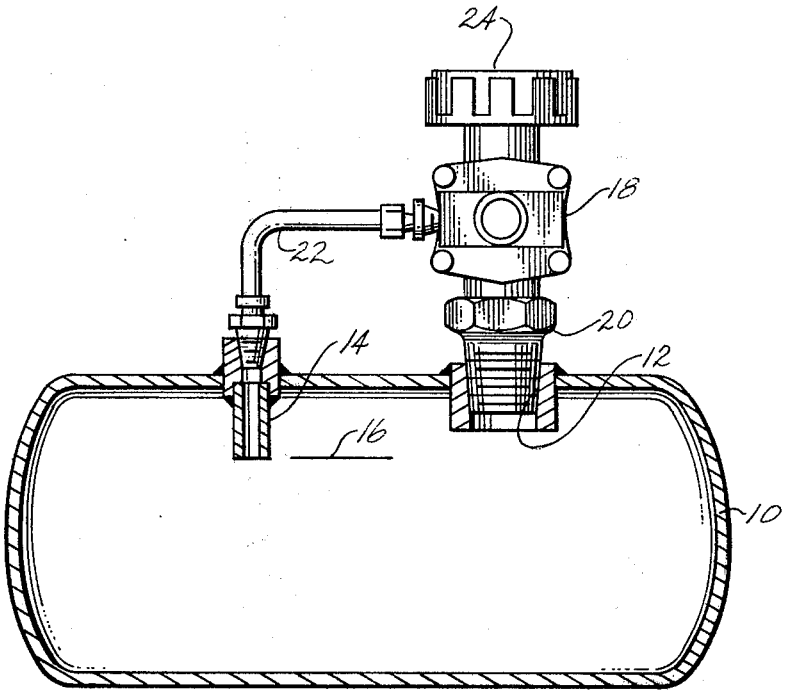
FIG. 1 is a side, partially sectional view of an automatic shutoff valve connected to a tank having a dip tube.

In FIG. 1 a tank 10 suitable for storage of a volatile liquid, such as LPG, has a threaded inlet 12 and dip tube 14 facing in an upwardly direction. Tube 14 leads from a point in tank 10 at the maximum permitted liquid level designated 16 to the exterior of tank 10. An automatic shutoff valve 18 incorporating the principles of the invention is coupled to inlet 12 by a check valve 20. Valve 20 could comprise a so-called double-back check valve of a type manufactured by Sherwood Selpac, which is conventionally employed at the inlet of LPG tanks to prevent backflow. A control line 22 is connected from dip tube 14 to automatic shutoff valve 18 to feed gas thereto when the liquid level in tank 10 is below maximum level 16, and liquid thereto when the liquid level in tank 10 is at or above maximum level 16. A screw cap 24 covers the main inlet of automatic shutoff valve 18 when tank 10 is not being filled.

Figure 2:
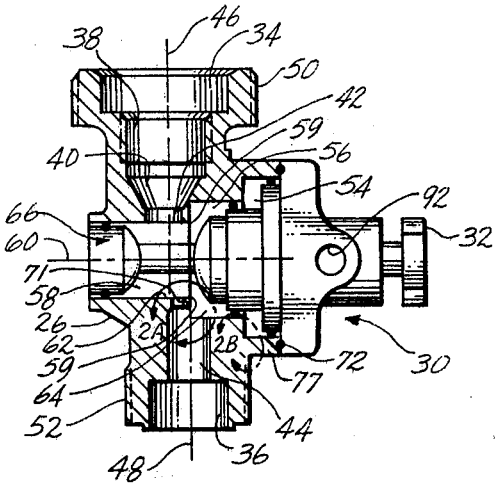
FIG. 2 is an end, partially sectional view of the shutoff valve of FIG. 1.

As shown in FIG. 2, automatic shutoff valve 18 comprises a valve body 26, a piston actuator assembly 66, a cover 30, and a manual venting valve 32. A main cylindrical inlet 34 is formed at the top of valve body 26, and a main cylindrical outlet 36 is formed at the bottom of valve body 26. Between main inlet 34 and main outlet 36 is formed a main flow passage comprising a large cylindrical section 38, a converging conical section 40, a small cylindrical section 42, and a small cylindrical section 44. Inlet 34, as well as sections 38, 40, and 42 are aligned with an inlet axis 46. Outlet 36 and section 44 are aligned with an outlet axis 48 parallel to, and laterally offset from, axis 46. The portion of housing 26 surrounding inlet 34 has male threads 50 to receive cap 24. The portion of housing 26 surrounding outlet 36 has male threads 52 to receive check valve 20.

Figure 2A:
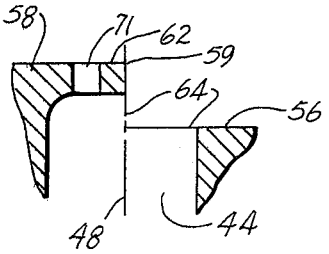
FIG. 2A and 2B are enlargements of parts of the valve body of FIG. 2.

A control chamber comprising a large cylindrical section 54 and a piston chamber comprising an intermediate cylindrical section 56 and a small cylindrical section 58 extend through housing 26 from side to side in alignment with an axis 60 that is perpendicular to axes 46 and 48. The piston chamber intersects and thus forms part of the main passage. Section 58 of the piston chamber is separated from section 44 of the main passage of part of valve body 26 designated partition 62 (FIG. 2A). An opening 64 is formed in the end and sidewall of section 56 of the piston chamber to connect it with section 44. Section 44 extends into valve body 26 beyond the perimeter of section 56 so as to increase the cross sectional area of opening 64 and facilitate construction of valve body 26. The edge of the annular first shoulder formed between sections 56 and 58 serves as a valve seat 59 within the piston chamber in the main flow passage.

Figure 5:
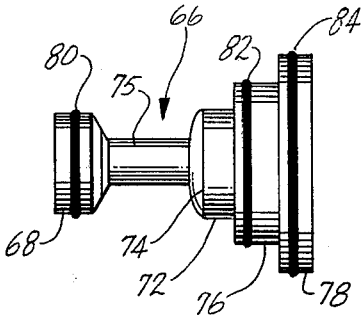
FIG. 5 is a side elevation view of the piston and actuator of FIG. 2.

Piston-actuator assembly 66 is movable back and forth through the piston chamber and control chamber. As shown in FIG. 5, piston-actuator assembly 66 comprises in an integral construction a small piston element 68, a plug 72 having a conical or convexly curved sealing surface 74, a connecting rod 75 between piston element 68 and plug 72, a large piston element 76, and an actuator element 78. Actuator element 78 has a larger diameter than piston element 76, and piston element 76 has a larger diameter than piston element 68. An O-ring seal 80 is retained in a groove formed around the cylindrical surface of piston element 68. An O-ring seal 82 is retained in a groove formed around the cylindrical surface of piston element 82. An O-ring seal 84 is retained in a groove formed around the cylindrical surface of actuator element 78. Piston element 68 rides back and forth in section 58; fluid leakage therebetween is prevented by seal 80. Piston element 76 and plug 72 move back and forth in section 56; fluid leakage therebetween is prevented by seal 82. Actuator element 78 moves back and forth in section 54; fluid leakage therebetween is prevented by seal 64. Piston elements 68 and 76 and actuator element 78 serve to axially align and guide the movement of piston actuator assembly 66 through the piston chamber.

Figure 3:
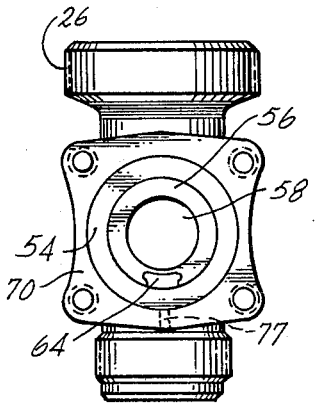
FIG. 3 is a side elevational view of the valve body of FIG. 2.
Figure 2B:
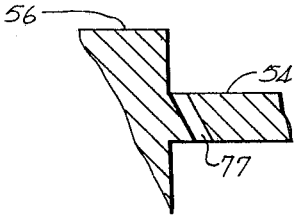

Cover 30 is secured by fasteners, not shown, to a mounting flange 70 (FIG. 3) formed on valve body 26 around section 54. A face seal 72 between cover 30 and mounting flange 70 prevents fluid escape therebetween. Piston-actuator assembly 66 moves back and forth through the piston and control chambers between one extreme position, in which sealing surface 74 engages valve seat 59 to form a seal along the line of contact therebetween and close the main passage, and another extreme position in which actuator element 78 abuts cover 30 to open the main passage. To provide fluid communication between the main passage and section 56 when the main passage is closed, a small hole 71, e.g., a number 54 drill, is formed in partition 62 of valve body 26. A small hole 77, e.g., a number 54 drill, leads from section 54 where it forms the shoulder with section 56 to the exterior of valve body 26 (FIG. 2B).

Figure 4:
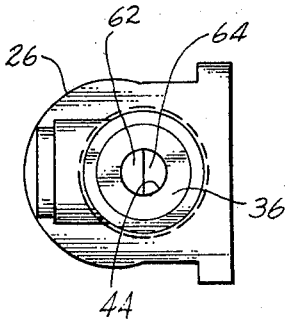
FIG. 4 is a bottom plan view of the valve body of FIG. 2.

In order for the main flow passage from inlet 34 to outlet 36 to close when sealing surface 74 engages valve seat 59, it is a requirement that the inlet portion of the main passage open into section 58, and the outlet portion of the main passage open into section 56. Outlet axis 48 is offset laterally with respect to inlet axis 46 to facilitate die-casting of valve body 26 in view of this requirement. Valve body 26 is die-cast with the aid of three metal cores. One core forms inlet 34 and sections 38 and 40. A second core forms outlet 36 and section 44. A third core forms sections 54, 56, and 58. The third core also has an elongated finger extending from one side thereof which serves to form opening 64. This elongated finger has the shape of opening 64 shown in FIGS. 2 and 3. The space between the finger and the remainder of the third core defines partition 62. As is evident from FIG. 2, offsetting axis 48 laterally to the right relative to axis 46 reduces the length of the finger of the third core, and thus the length of partition 62, and increases the cross sectional area of opening 64 by permitting more of section 44 to open directly into section 56. Preferably, axis 48 is aligned with the plane of the shoulder between sections 56 and 58, so that partition 62 extends only across one-half of the cross sectional area of section 44 (see FIG. 4). This construction forms partition 62, so it is not too long to be weakened, and provides an adequate cross sectional area for opening 64, without lengthening section 56.

Figure 6:
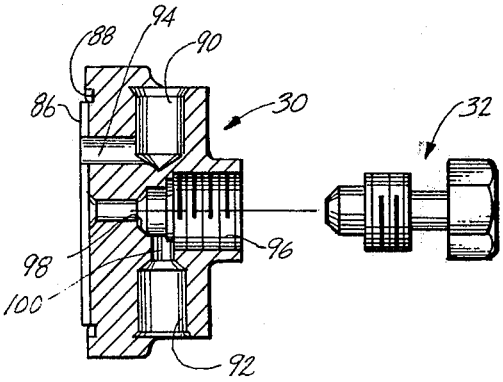
FIG. 6 is a top sectional view of the end cap of FIG. 2.

As shown in FIG. 6, the face of cover 30 that abuts mounting flange 70 has a circular protrusion 86, which serves to center cover 30 within section 54, and an annular groove 88, which serves to retain face seal 72.

Aligned bores 90 and 92 are formed in cover 30 transverse to axis 60 and axes 46 and 48. Bore 90 is threaded to receive the connecting fitting of control line 22. Bore 92 opens into the atmosphere. A bore 94 leads transversely from bore 90 to the face of cover 30 abutting mounting flange 70. A passage 96 is formed in cover 30 from end to end, opening at one end to the face abutting mounting flange 70. At the other end, passage 96 is threaded to receive venting valve 32. Passage 96 has a conical surface 98, which serves as a seat for venting valve 32. A small bore 100 connects bore 92 to passage 96 at a point between conical surface 98 and the threaded end thereof.

Seal 80 creates on piston element 68 an area against which fluid pressure in the main passage acts. Seal 82 creates on plug 72 and piston element 76 a larger area against which fluid pressure in the main passage acts. (Fluid pressure in the main passage is permitted to act on piston element 76, even when the main passage is closed because of hole 71.) Seal 84 creates on actuator element 78 a still larger area, because of the larger diameter and absence of rod 75, against which fluid pressure in the control chamber acts. Seal 82 prevents the fluid pressure in the main passage from acting on the other side of actuator element 78. When the tank is not being filled, cap 24 is secured on valve body 26, and venting valve 32 seats on conical surface 98 to prevent venting of the control chamber. To fill tank 10, cap 24 is removed, and a source of LPG is connected to inlet 34. Automatic shutoff valve 18 remains closed, and the control chamber is maintained at the full gas pressure within tank 10, because the fluid fed to the control chamber by dip tube 14 cannot escape therefrom. Thus, approximately the same pressure acts against the area of plug 72 and piston element 76 and the larger area of actuator element 78, thereby driving piston-actuator assembly 66 to its closed position. When venting valve 32 is opened, the gas fed to the control chamber escapes through bore 92 to the atmosphere, thereby sharply reducing the pressure in the control chamber. The pressure of the LPG in the main passage, which not only acts against plug 72, but also against piston element 76 by virtue of hole 71 (FIG. 2A), exerts a larger force on piston-actuator assembly 66 than the pressure acting against piston element 68 and the pressure in the control chamber acting on actuator element 78. Thus, piston-actuator assembly 66 is driven into abutment with cover 30 to open the main passage. LPG then flows into tank 10, and valve 18 remains open until the liquid level in tank 10 reaches dip tube 14, at which time liquid is fed into the control chamber. Because of the restrictions through which the fluid must flow from dip tube 14 through the control chamber to the atmosphere, the pressure in the control chamber is much larger when the fluid is liquid than when the fluid is gas. (By way of example, a restriction of 0.156 inches could be provided between tube 14 and the control chamber and a restriction of 0.093 inches could be provided between the control chamber and the atmosphere.) Thus, when the liquid level in tank 10 reaches dip tube 16, liquid is fed into the control chamber, and the force exerted on actuator member 78 by the pressure in the control chamber, and the pressure acting on piston element 68, becomes greater than the force exerted on piston member 76 by the pressure in the main passage. Piston actuator assembly 66 is then driven until sealing surface 74 engages the valve seat, thereby automatically shutting off valve 18. Seal 84 makes the control chamber fluidtight, and thus permits rapid buildup of pressure against the area of actuator element 78 facing cover 30. This causes valve 18 to shut off quickly when the liquid in tank 10 reaches the maximum level.

In the event that seal 82 fails, fluid leaking into section 54 from section 56 is vented to the atmosphere through hole 77. This prevents the pressure in the main passage from acting against the area of actuator element 78 facing away from cover 30, which would prevent piston actuator 66 from moving to its closed position.

The described embodiment of the invention is only considered to be preferred and illustrative of the inventive concept; the scope of the invention is not to be restricted to such embodiments. Various and numerous other arrangements may be devised by one skilled in the art without departing from the spirit and scope of this invention. For example, although it is preferable, from a fabrication, assembly, and alignment point of view, for the actuator element to be an integral part of the piston assembly as shown, the invention also functions with an actuator element separate from the piston assembly. In such case, the actuator element would still drive the piston assembly so its sealing surface engages the valve seat when the pressure rises in the control chamber, and the actuator element would be driven against the cover by the piston element when the pressure drops in the control chamber.

What is claimed is:

1. An automatic shutoff valve comprising:

a valve body;

a main inlet, a main outlet, and a main passage from the main inlet to the main outlet formed in the valve body;

a piston chamber formed in the valve body, the piston chamber having a valve seat in the main passage, a piston movable through the piston chamber between a first position in engagement with the valve seat to close the main passage and a second position out of engagement with the valve seat to open the main passage;

a first seal between the piston and piston chamber creating on the piston a first area against which fluid pressure in the main passage acts to urge the piston toward its second position;

a control chamber in fluid communication with one end of the piston chamber, the control chamber having an inlet and an outlet;

an actuator movable through the control chamber between a first position and a second position to drive the piston toward its first position when the actuator moves towards its first position and to be driven by the piston towards its second position when the piston moves towards its second position; and a second seal between the actuator and the control chamber creating on the actuator a second area larger than the first area against the fluid pressure in the control chamber acts to urge the actuator towards its first position;

the inlet and outlet of the control chamber being in fluid communication with the second area of the actuator.

2. The valve of claim 1, additionally comprising a venting passage formed in the valve body between the piston chamber and the exterior of the valve body, the venting passage opening into a region of the piston chamber between the first and second seals.

3. The valve of claim 1, in which the main inlet is aligned with an inlet axis, and the main outlet is aligned with an outlet axis parallel to and laterally displaced from the inlet axis.

4. The valve of claim 3, in which the piston chamber comprises a small cylindrical section and an intermediate cylindrical section lying on an axis transverse to the inlet and outlet axes, a shoulder is formed where the small cylindrical section and the intermediate cylindrical section meet, the valve seat is formed by the shoulder, the piston is movable through the intermediate section, the main inlet opens into the small section, and the main outlet opens into the intermediate section.

5. The valve of claim 4, in which the shoulder is flat, the valve seat is the edge of the shoulder, the outlet axis is aligned with the plane of the shoulder such that part of the valve body separates part of the internal end of the main outlet and the small section of the piston chamber, and the remainder of the internal end of the main outlet opens directly into the intermediate chamber.

6. The valve of claim 5, in which part of the valve body separates one-half of the cross sectional area of the internal end of the outlet.

7. A storage system for a volatile liquid comprising:

a storage tank having an inlet;

a dip tube extending into the tank to a maximum fill level;

a valve body;

a main inlet, a main outlet, and a main passage from the main inlet to the main outlet formed in the valve body;

means for connecting the main outlet to the tank inlet;

a piston chamber formed in the valve body, the piston chamber having a valve seat in the main passage, a piston movable through the piston chamber between a first position in engagement with the valve seat to close the main passage and a second position out of engagement with the valve seat to open the main passage;

a first seal between the piston and piston chamber creating on the piston a first area against which fluid pressure in the main passage acts to urge the piston toward its second position;

a control chamber in fluid communication with one end of the piston chamber;

an actuator movable through the control chamber between a first position and a second position to drive the piston toward its first position when the actuator moves towards its first position and to be driven by the piston towards its second position when the piston moves towards its second position;

a second seal between the actuator and the control chamber creating on the actuator a second area larger than the first area against which fluid pressure in the control chamber acts to urge the actuator towards its first position; and means for generating a sufficient pressure in the control chamber responsive to liquid in the dip tube to overcome the force of the liquid pressure exerted on the first area, thereby driving the actuator toward its first position, without generating sufficient pressure in the control chamber to do so responsive to gas in the dip tube.

8. The system of claim 7, additionally comprising a venting passage formed in the valve body between the piston chamber and the exterior of the valve body, the venting passage opening into a region of the piston chamber between the first and second seals.

9. The system of claim 7, in which the main inlet is aligned with an inlet axis, and the main outlet is aligned with an outlet axis parallel to and laterally displaced from the inlet axis.

10. The system of claim 9, in which the piston chamber comprises a small cylindrical section and an intermediate cylindrical section lying on an axis transverse to the inlet and outlet axes, a shoulder is formed where the small cylindrical section and the intermediate cylindrical section meet, the valve seat is formed by the shoulder, the piston is movable through the intermediate section, the main inlet opens into the small section, and the main outlet opens into the intermediate section.

11. The system of claim 10, in which the shoulder is flat, the valve seat is the edge of the shoulder, the outlet axis is aligned with the plane of the shoulder such that part of the valve body separates part of the internal end of the main outlet and the small section of the piston chamber, and the remainder of the internal end of the main outlet opens into the intermediate chamber.

12. The system of claim 11, in which part of the valve body separates one-half of the cross sectional area of the internal end of the outlet.

13. The system of claim 7, in which the generating means comprises means including a restriction for fluidically coupling the dip tube to the control chamber and means including a restriction for venting the control chamber to the atmosphere.

14. An automatic shutoff valve comprising:

a valve body;

a main inlet, a main outlet, and a main passage from the main inlet to the main outlet formed in the valve body, the main inlet being aligned with an inlet axis, and the main outlet is aligned with an outlet axis parallel to and laterally displaced from the inlet axis;

a piston chamber formed in the valve body, the piston chamber having a valve seat in the main passage;

a piston movable through the piston chamber between a first position in engagement with the valve seat to close the main passage and a second position out of engagement with the valve seat to open the main passage;

a seal between the piston and piston chamber creating on the piston a first area against which fluid pressure in the main passage acts to urge the piston toward its second position;

a control chamber in fluid communication with one end of the piston chamber, the control chamber having an inlet and an outlet; and an actuator movable through the control chamber between a first position and a second position to drive the piston toward its first position when the actuator moves towards its first position and to be driven by the piston toward its second position when the piston moves towards its second position, the actuator having a second area against which fluid pressure in the control chamber acts to urge the actuator towards its first position;

the inlet and outlet of the control chamber being in fluid communication with the second area of the actuator.

15. The valve of claim 14, in which the piston chamber comprises a small cylindrical section and an intermediate cylindrical section lying on an axis transverse to the inlet and outlet axes, a shoulder is formed where the small cylindrical section and the intermediate cylindrical section meet, the valve seat is formed by the shoulder, the piston is movable through the intermediate section, the main inlet opens into the small section, and the main outlet opens into the intermediate section.

16. The valve of claim 15, in which the shoulder is flat, the valve seat is the edge of the shoulder, the outlet axis is aligned with the plane of the shoulder such that part of the valve body separates part of the internal end of the main outlet and the small section of the piston chamber, and the remainder of the internal end of the main outlet opens directly into the intermediate chamber.

17. The valve of claim 16, in which the part of the valve body separates one-half of the cross sectional area of the internal end of the outlet.

* * * * *

UNITED STATES PATENT AND TRADEMARK OFFICE

CERTIFICATE OF CORRECTION

PATENT NO. : 4,405,000

DATED : September 20, 1983

INVENTOR(S) : William J. Fuller

It is certified that error appears in the above-identified patent and that said Letters Patent is hereby corrected as shown below:

Col. 2, line 67, "FIG" should be --FIGS--

Col. 3, line 1, "elevational" should be --elevation--
line 59, "first" should be --flat--

Col. 4, line 16, "64" should be --84--

Col. 6, line 58, "the" second occurrence, should be --which--

Signed and Sealed this

*Twenty-ninth* Day of *January 1985*

[SEAL]

*Attest:*

DONALD J. QUIGG

*Attesting Officer* *Acting Commissioner of Patents and Trademarks*